US006425788B1

(12) United States Patent
Lindholm

(10) Patent No.: US 6,425,788 B1
(45) Date of Patent: Jul. 30, 2002

(54) CONTROLLABLE-PITCH PROPELLER

(75) Inventor: Jan-Erik Lindholm, Västerskog (FI)

(73) Assignee: AB R & D Marine OY, Vasterskog (FI)

( * ) Notice: Subject to any disclaimer, the term of this patent is extended or adjusted under 35 U.S.C. 154(b) by 0 days.

(21) Appl. No.: 09/894,280

(22) Filed: Jun. 27, 2001

(51) Int. Cl.[7] ..... B63H 3/00
(52) U.S. Cl. ..... 440/50; 416/157 R
(58) Field of Search ..... 440/50; 416/147, 416/153, 154, 156, 157 R, 162

(56) References Cited

U.S. PATENT DOCUMENTS

| | | | | | |
|---|---|---|---|---|---|
| 3,690,788 | A | * | 9/1972 | Pedersen | 416/157 R |
| 4,142,835 | A | * | 3/1979 | Hisada | 416/157 R |
| 4,523,891 | A | * | 6/1985 | Schwartz et al. | 416/157 R |
| 4,781,533 | A | * | 11/1988 | Andersson | 416/157 R |
| 4,907,992 | A | * | 3/1990 | Cavallaro et al. | 416/157 R |
| 5,226,844 | A | * | 7/1993 | Muller | 440/49 |
| 5,364,231 | A | * | 11/1994 | Eick et al. | 416/157 R |
| 5,836,743 | A | * | 11/1998 | Carvalho et al. | 416/139 |

* cited by examiner

*Primary Examiner*—Stephen Avila
(74) *Attorney, Agent, or Firm*—Smith-Hill and Bedell

(57) ABSTRACT

The invention relates to a propeller suited for installation in boats and vessels and having a run-time controllable pitch of propeller blades (4). The propeller comprises a hollow hub casing (2) containing a sleeve (10) adaptable about the propeller shaft (3) and adapted to rotate along with the propeller shaft (3), a fixed stator (6) adapted about said sleeve (10) and including pressurized-medium spaces (11, 12) connectable to a pump (9), at least one double-acting servomotor adapted into the interior of said hub casing (2) for altering the pitch of said propeller blades (4), said servomotor being adapted to rotate with said propeller shaft (3), ports (14, 20; 15, 19) adapted to said sleeve (10) for transmission of a pressurized fluid between said pressurized fluid spaces (11, 12) and said servomotor, and a valve (28) connected to the ports (14, 20; 15, 19) and adapted to lock the pitch of said propeller blades (4) to a fixed pitch by way of preventing the flow of said pressurized medium from said pressurized-medium space (11, 12) to said servomotor and, respectively, out from said servomotor to said pressurized medium space (11, 12) when the pressure in said pressurized-medium space (11, 12) falls below a certain level.

5 Claims, 3 Drawing Sheets

A - A

CONTROLLABLE-PITCH PROPELLER

The present invention relates to a method for controlling the pitch of a marine propeller suited for installation on outboard motors and Z-drives, among others. The invention is based on a mechanism that rotates each one of the propeller blades about a radial axis that is essentially orthogonal to the propeller axis and thus implements the adjustment of the blade angle-known as pitch.

For blade pitch adjustment, the most commonly used mechanism type comprises a lever arm connected to the blade root, generally orthogonal to the rotation axis thereof, and a cylinder rod that is connected to the lever arm and is adapted to move axially in respect to the hub bore in a parallel direction to the propeller shaft. The blade is mounted on the hub by means of radial and axial bearings. The movement of the piston rod is typically achieved by means of hydraulic servomotors that may be arranged to operate in the interior of the hub and rotating with the hub, or be of the stationary type and be placed about the hub.

In applications implemented by means of rotary servomotors, a hydraulic fluid reservoir must be provided wherefrom hydraulic oil or other pressurized medium is delivered by a stationary pump to the rotary servomotors. Such a hydraulic fluid reservoir that has seals specified for a high pressure and rapid slide movements for an extended period of time is complicated to manufacture and highly subject to leak. Also its size becomes excessively large for adaptation to, e.g., a normal-size propeller hub of an outboard motor so that a sufficient space can be reserved for exhaust channels and the like. If the pressurized-medium reservoir is located outside the propeller hub, the space needed by such constructions cause disturbance to the water flow about the propeller. An example of such prior-art-construction can be found in U.S. Pat. No. 5,226,844.

The flow of the pressurized medium to the servomotors is conventionally controlled by valves that may be placed exterior to the pressurized-medium reservoir or directly into the hub as is taught in U.S. Pat. No. 4,781,533. The valves themselves are controlled by a separate mechanism such as an auxiliary servomotor. If the valves are placed in the hub, the control mechanism must typically be designed capable of transmitting the movement of a stationary source of control power via, e.g., a slide ring to a rotary valve shaft. Such a mechanism conventionally requires a hollow propeller shaft with substantial space thereabout, which makes it difficult to develop control mechanisms suitable for, e.g., retrofit to an outboard motor. In applications known in the art, the control valves are connected so that the pressurized-medium reservoir is kept continuously pressurized when the propeller is running. Resultingly, as mentioned above, the seals must endure high pressure and rapid sliding movements for long periods of time.

Constructions implemented using stationary servomotors need a transmission with bearings for applying the axial force to the cylinder rods that rotate with the propeller shaft as is taught in U.S. Pat. No. 4,142,835. Herein, high forces are encountered and they require the use of big axial bearings that are obviously difficult to adapt into a small space.

The above-mentioned techniques suffer from frictional power loss occurring in both the sealing assemblies of the pressurized medium reservoir and the axial bearings. Other disadvantages of these prior-art techniques are that the piping between the servomotor and the check valves of the hydraulic pump become long and, hence, the volume of the pressurized medium in the piping is large. This causes play and inaccuracy in pitch control due to expansion of piping and a certain degree of com-pressibility of the pressurized medium, particularly if the medium is not air-free.

In U.S. Pat. No. 3,690,788 is disclosed a propeller mechanism, wherein the flow of pressurized fluid is cut off by means of a spool-like valve between the servomotor controlling the pitch of the propeller blades and the pressurized fluid reservoir. As the spool thus prevents the flow of pressurized hydraulic fluid to the servomotor and away therefrom, the propeller blades are locked to a fixed pitch. The space containing the pressurized fluid reservoir is under pressure only when the propeller pitch is being altered. In the above-described construction, the spool controlling the flow of the pressurized medium is located aft of the end of the propeller shaft coaxially with the propeller shaft, which arrangement makes the propeller hub enclosing the mechanism long and very large in size. Hence, the construction is difficult to adapt to plural applications.

It is an object of the invention to overcome the disadvantages and problems hampering prior-art constructions described above.

The goal of the invention is achieved by cutting off the flow of the pressurized medium between the servomotor controlling the propeller pitch and the space containing the pressurized-medium by means of a pressure-controlled valve assembly when the pressure in the pressurized-medium space falls at a given low level. Thus, the valve assembly prevents inflow of the pressurized medium to the servomotor and outflow therefrom, whereby the locking of the propeller pitch to a fixed pitch is effected. The valve assembly is located into a sleeve enclosing the propeller shaft, advantageously radially, whereby the valve assembly does not occupy any extra space in the axial direction of the propeller shaft.

The invention offers significant benefits.

Accordingly, the invention makes it possible to implement a controllable-pitch propeller featuring reduced wear and friction in the seals of the pressurized-medium reservoir. The hydraulic play is minimized through minimized volume of pressure spaces in the system. The mechanism according to the invention occupies only a small space in the hub thus permitting retrofitting on outboard motors, for example.

In a controllable-pitch propeller according to the invention, the pressurized medium reservoir, wherefrom the pressurized medium delivered thereto by a stationary pump is passed to one or more servomotors rotating with the propeller shaft, is unpressurized at times when pitch control is not effected. In the following, the number of servomotors is assumed to be one, but obviously a greater number may be used depending on a specific application. Locking of piston movement in the servomotor is implemented by means of a valve assembly that with a falling of the pressure in the pressurized-medium reservoir cuts off the flow of the pressurized medium into and out from the hydraulic cylinder compartments at both sides of the piston. In reality, this means that the propeller becomes locked to a fixed pitch without any need to subject the seals of the pressurized-medium reservoir to pressure during the time the pump is nonoperative. A characterizing feature is that the valves rotate with the servomotor about the propeller shaft and that they are connected between the pressurized medium reservoir and the servomotor. Additionally, the valves shall have such a construction that requires no external steering mechanism, whereby the valves are controlled in a self-contained manner by the pressure acting in the pressurized-medium reservoir.

In the following, the invention will be examined in greater detail with the help of an exemplifying embodiment and making reference to the appended drawings in which FIG. 1 shows the location of the propeller on the gearcase;

Figure 1:
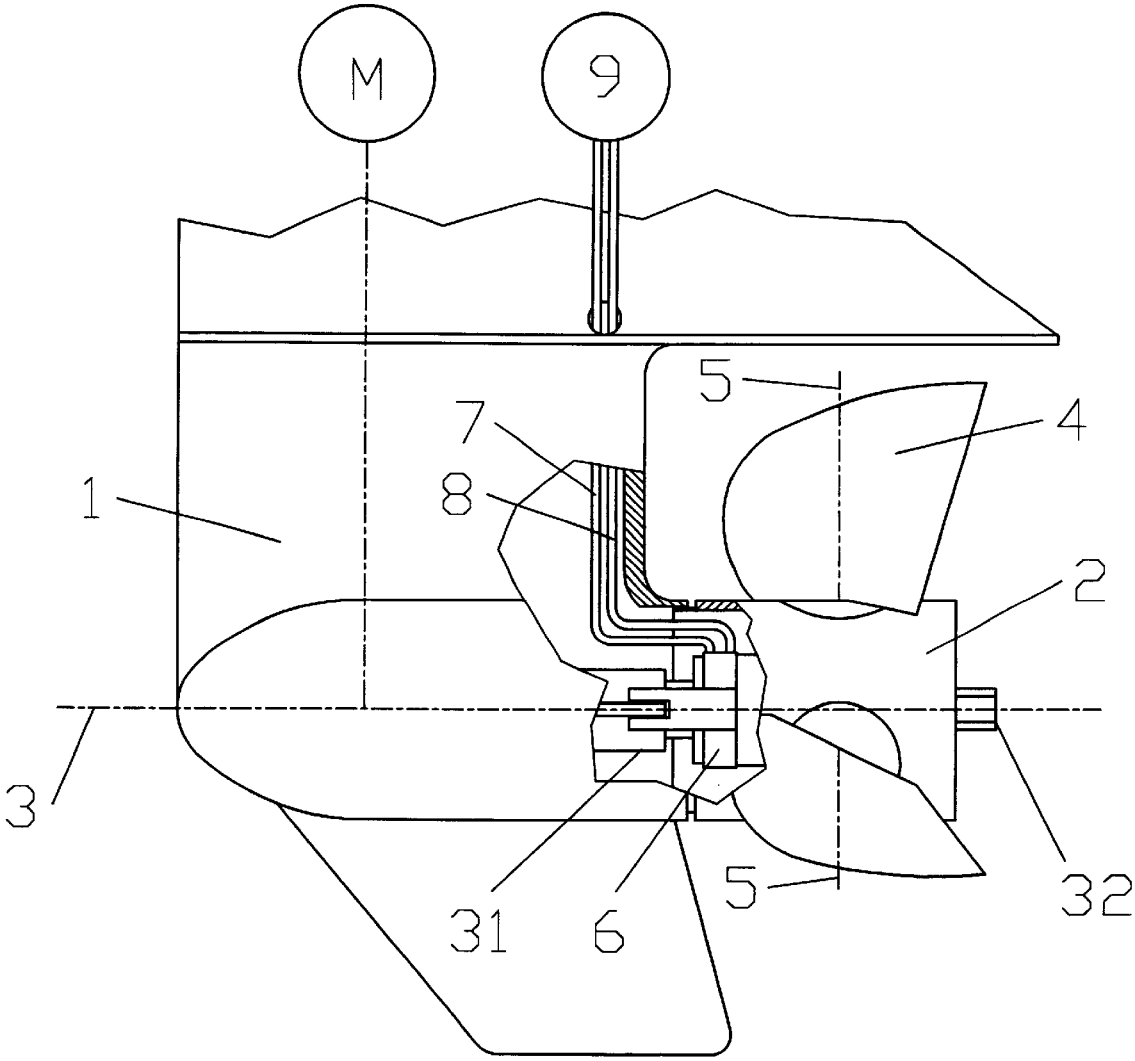

Referring to FIG. 1, therein is schematically shown the technique, to be elucidated in more detail later, of mounting a controllable-pitch propeller mechanism into the gearcase 1. The gearcase may be such as is used, e.g., in an outboard motor or a Z-drive The propeller pitch control mechanism according to the invention is adapted about the propeller shaft of a boat or vessel. The hollow propeller hub 2 and the blades 4 rotate with the propeller shaft 3. Additionally, the propeller blades 4 are arranged to be rotatable about a radial axis 5 that is essentially orthogonal to the propeller shaft 3. The number of blades can be two or more. The propeller shaft 3 is adapted to fit into a sleeve 10 located in the interior of the hub 2 so that the sleeve can rotate with the propeller shaft 3. A stator 6 that surrounds the sleeve 10 is mounted on the gearcase 1 in a fixed manner preventing its rotation with the propeller shaft 3. The stator 6 is adapted about that portion of the sleeve 10, which surrounds the propeller shaft 3. From the stator 6 are passed two hydraulic fluid lines 7, 8 to a hydraulic pump 9. Into the stator 6 are formed two annular hydraulic fluid spaces 11, 12 that are separated from each other and made pressure-tight to the exterior space by means of seals 13. This space may also be understood to act as a pressurized fluid reservoir. The hydraulic fluid spaces 11, 12 are delineated by the rotary sleeve 10, whereby the exterior surface of the sleeve 10 forms one wall of the hydraulic fluid spaces 11, 12.

From the hydraulic fluid spaces 11, 12 are passed ducts 14, 15 in the body of the sleeve 10 to a valve assembly 28. The valve assembly 28 is located in the portion of the sleeve 10 that surrounds the propeller shaft 3 so that the valve assembly is disposed between the aft end of the propeller shaft 32 and the aft bearing 31. From the valve assembly 28 are passed ducts 19, 20 to the hydraulic oil space 21 and 22, respectively. The hydraulic fluid spaces 21 and 22 are separated from each other by an annular piston 23 surrounding the propeller shaft 3. A cylinder 26, piston 23 and fork 24 form a hydraulic double-acting servomotor. The servomotor is adapted about that portion of the sleeve 10, which surrounds the propeller shaft 3. The piston 23 cooperates with the fork 24 that in turn is connected to a lever arm of the blade 4 by means of a screw, pin or similar fixing element 25. The blade 4 is rotatably mounted on a shaft 5 by means a bearing 27 capable of supporting the blade radially and axially. As the stator 6, the valve assembly 28 and the servomotor are disposed between the aft end 32 of the propeller shaft 3 and bearing assembly 33 located in the gearcase 1 of the propeller shaft 3, the propeller hub casing 2 can be short.

Figure 2:
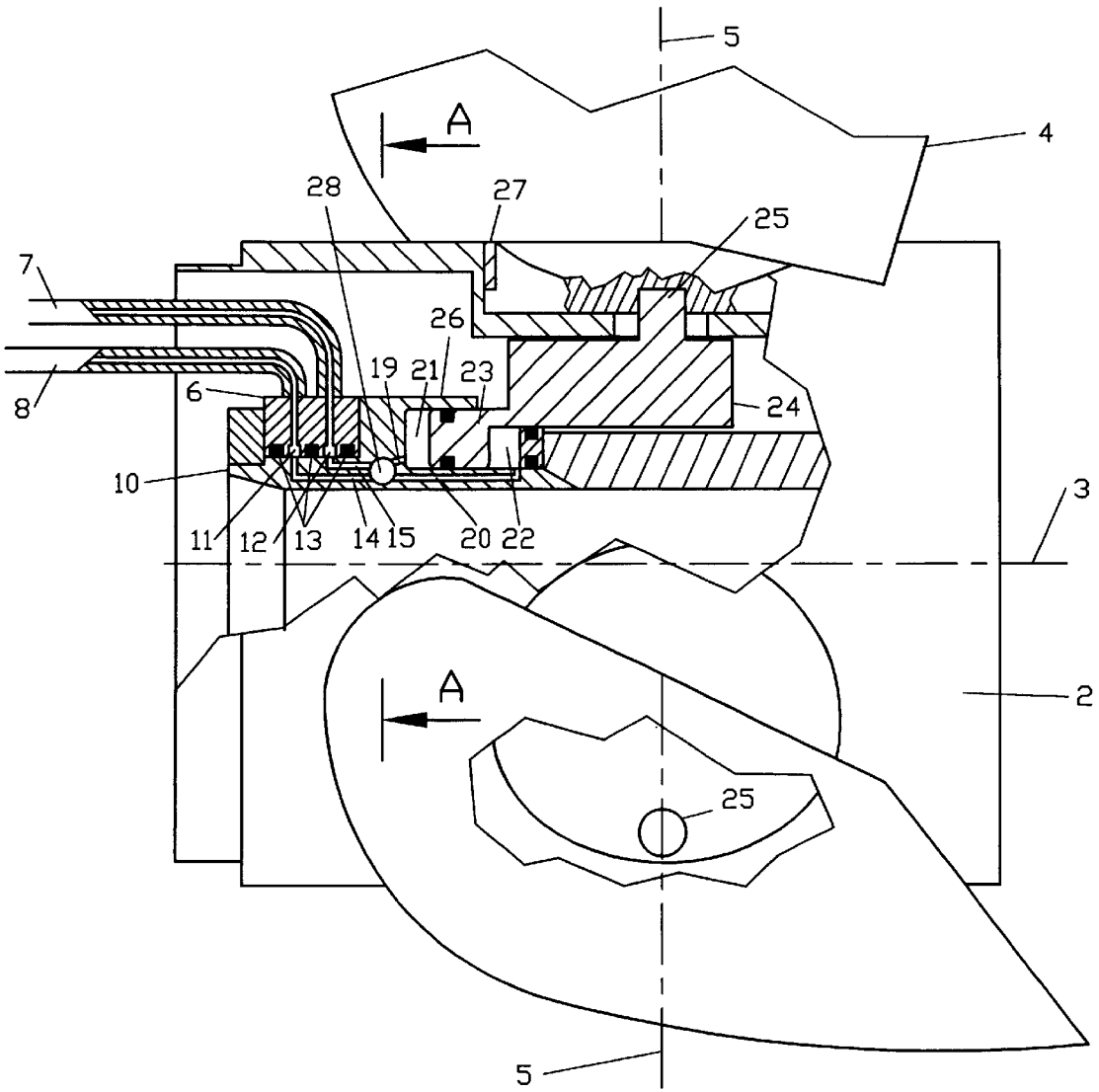
FIG. 2 shows a sectional view of the mechanism.
Figure 3:
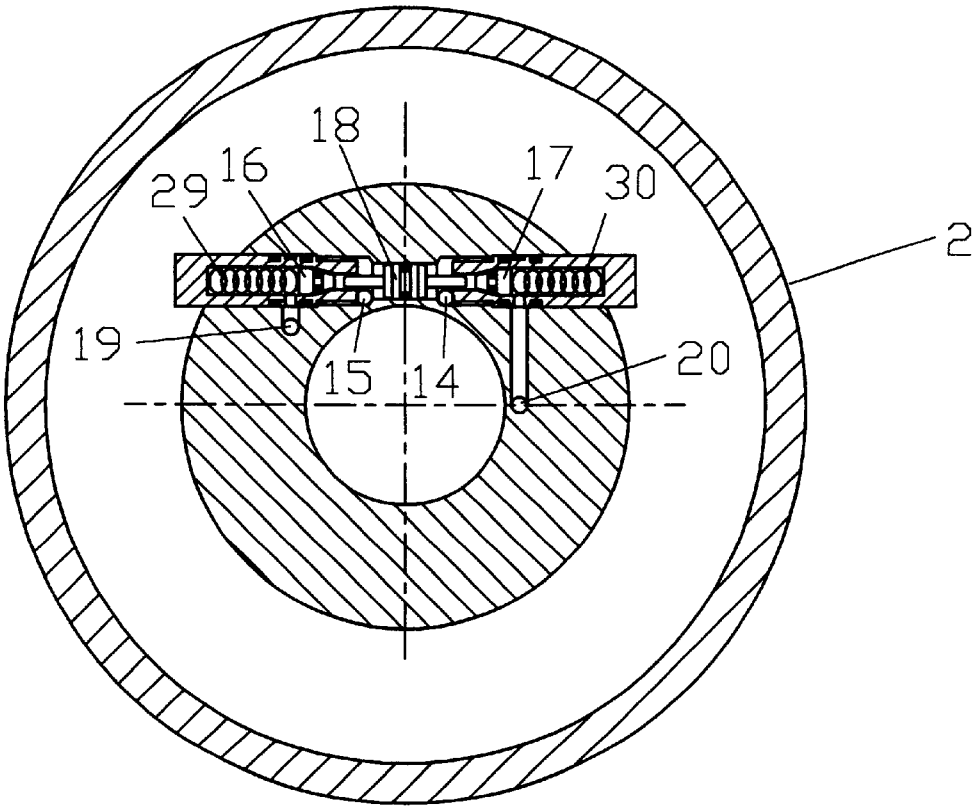
FIG. 3 shows a sectional view of the embodiment of FIG. 2 taken along line A—A exposing detailed construction of valve assembly 28.

The valve assembly 28 is adapted into a bore made into the sleeve 10 in a crosswise direction, whereby the longitudinal axis of the valve assembly 28 is oriented substantially orthogonal to the center axis of the sleeve 10. The valve assembly 28 is a two-compartment hydraulically controlled directional valve capable of controlling two separate lines of pressurized hydraulic fluid so that either both lines are cut off or both are on, depending on the pressure of the hydraulic fluid acting at valve ports 14, 15. The valve assembly 28 comprises an integrated construction formed by valves 16, 17 with a control piston 18 controlling the same. When hydraulic fluid is applied from pump 9 via duct 7 to port 15, the piston of valve 16 moves to the left against a spring 29, thus allowing the fluid to flow into duct 19. Simultaneously, the piston 18 is driven to the right in FIG. 3 thus opening valve 17, whereby the hydraulic fluid can flow from duct 20 to port 14. The hydraulic fluid can now flow via duct 19 to space 21 and via ducts 20, 14 and 8 out from space 22, thus effecting the movement of piston 23 and fork 24 with peg 25 to the right in FIG. 2. Resultingly, the blade 4 is forced to rotate about its axis 5. When the pump is shut off and the pressure at port 14 falls below a certain level, valves 16 and 17 are closed by springs 29 and 30. Inasmuch no hydraulic fluid can now flow into or out from hydraulic fluid space 21 or 22, piston 23 remains hydraulically locked into its current position and the propeller thus remains locked to a fixed pitch as long as the pump is inoperative.

With an increasing pressure at port 15, the operation takes place in a reverse order. Accordingly, the hydraulic fluid in lines 7, 8 and at ports 14, 15 need not stay in a pressurized state in order to keep the propeller at a fixed pitch, because valves 16 and 17 remain closed as long as the pressure in the hydraulic fluid reservoir is low. Due to the low pressure acting on the seals 13, the wear and friction of the seals is reduced. Hence, the seals are subjected to higher load only during the short periods of time when the propeller pitch is being controlled.

What is claimed is:

1. Propeller suited for installation in boats and vessels and having a run-time controllable pitch of propeller blades (4), the propeller comprising a hollow hub casing (2) containing a sleeve (10) adaptable about the propeller shaft (3) and adapted to rotate along with the propeller shaft (3), a fixed stator (6) adapted about said sleeve (10) and including pressurized-medium spaces (11, 12) connectable to a pump (9), at least one double-acting servomotor adapted into the interior of said hub casing (2) for altering the pitch of said propeller blades (4), said servomotor being adapted to rotate with said propeller shaft (3), ports (14, 20; 15, 19) adapted to said sleeve (10) for transmission of a pressurized fluid between said pressurized-fluid spaces (11, 12) and said servomotor, and a valve (28) located in said sleeve (10), into the portion thereof adaptable about said propeller shaft (3), said valve being adapted to lock the pitch of said propeller blades (4) to a fixed pitch by way of preventing the flow of said pressurized medium from said pressurized-medium space (11, 12) to said servomotor and, respectively, out from said servomotor to said pressurized-medium space (11, 12) when the pressure in said pressurized medium space (11, 12) falls below a certain level.

2. Propeller according to claim 1, wherein the longitudinal axis of said valve (28) is oriented substantially orthogonal to the center axis of said sleeve (10).

3. Propeller according to claim 1, wherein said valve (28) is a hydraulically controlled two-compartment directional valve.

4. Propeller according to claim 1, wherein said pressurized-medium spaces (11, 12) have an annular shape.

5. Propeller according to claim 1, wherein said servomotor is adapted about said sleeve (10).

* * * * *